US007464827B2

(12) United States Patent
Meissen

(10) Patent No.: US 7,464,827 B2
(45) Date of Patent: Dec. 16, 2008

(54) SHIPPING UNIT

(75) Inventor: Cynthia R. Meissen, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 768 days.

(21) Appl. No.: 10/968,684

(22) Filed: Oct. 18, 2004

(65) Prior Publication Data

US 2005/0109775 A1 May 26, 2005

Related U.S. Application Data

(60) Provisional application No. 60/512,024, filed on Oct. 17, 2003.

(51) Int. Cl.
*B65D 6/00* (2006.01)
*B65D 1/34* (2006.01)

(52) U.S. Cl. ..... 220/8; 220/1.5; 220/23.4; 220/4.03; 220/4.21; 220/4.26; 206/557; 229/101; 312/205; 312/301

(58) Field of Classification Search ..... 108/53.1–55.3, 108/901, 102, 902; 206/386, 503–512, 504, 206/507, 508, 499, 595–600, 557–567; 220/1.5, 220/23.2–23.8, 4.01–4.34, 630, 617, 8, 677, 220/682, 690, 691; 242/132; 229/101; 312/205, 312/301, 348.3; 73/429
See application file for complete search history.

(56) References Cited

U.S. PATENT DOCUMENTS 583,848 A * 6/1897 Dunlap ..... 433/41
635,962 A * 10/1899 Henley ..... 312/273
639,746 A * 12/1899 Macdonald ..... 206/758
876,235 A * 1/1908 Quackenboss ..... 47/66.1
2,265,618 A * 12/1941 Adams ..... 220/4.28
2,495,132 A * 1/1950 Remco ..... 220/23.4
2,617,699 A * 11/1952 Sullivan ..... 312/9.56
2,700,485 A * 1/1955 Goldberg et al. ..... 220/690
2,755,919 A * 7/1956 Genshaw et al. ..... 206/496
2,759,623 A * 8/1956 Hammarquist ..... 220/481
3,463,343 A * 8/1969 Asenbauer ..... 220/8
3,659,743 A * 5/1972 Box ..... 206/504
3,746,206 A * 7/1973 Utz ..... 220/214
3,887,102 A * 6/1975 Earley ..... 220/8
3,890,711 A * 6/1975 Burns ..... 433/41
3,918,781 A * 11/1975 Paris ..... 312/111
4,145,812 A * 3/1979 Johnson et al. ..... 433/41
4,564,118 A * 1/1986 Heyer et al. ..... 220/8
5,139,321 A * 8/1992 Beardsley ..... 312/209
5,192,019 A * 3/1993 Meehan ..... 229/101
5,368,159 A * 11/1994 Doria ..... 206/320
5,372,257 A * 12/1994 Beauchamp et al. ..... 206/504
5,458,248 A * 10/1995 Alain ..... 211/175

(Continued)

*Primary Examiner*—Nathan J Newhouse
*Assistant Examiner*—Ned A Walker
(74) *Attorney, Agent, or Firm*—Carlson, Gaskey & Olds

(57) ABSTRACT

A shipping unit for shipping items of varying length defines first and second tray sections which are connected and selectively move relative to one another to accommodate items of varying lengths. The first and second tray sections include base portions that allow shipping units to be stacked upon one another. Alternatively, the shipping unit includes a tray and a lid. The lid is connected to the tray and defines a tab and a slot on an end of the lid opposite the tab. The shipping units are connected by snap fitting the tab of one shipping unit into the slot of another shipping unit.

8 Claims, 3 Drawing Sheets

U.S. PATENT DOCUMENTS 5,617,953 A * 4/1997 Cope ..... 206/501
5,881,902 A * 3/1999 Ackermann ..... 206/509
5,992,665 A * 11/1999 Deeter ..... 220/23.4
6,273,259 B1 * 8/2001 Stahl ..... 206/511
6,325,221 B2 * 12/2001 Parham ..... 211/59.2
6,612,670 B2 * 9/2003 Liu ..... 312/312
6,691,884 B1 * 2/2004 Dwyer ..... 220/4.03
7,007,614 B2 * 3/2006 Gaunt et al. ..... 108/102
7,014,058 B2 * 3/2006 Gledhill ..... 220/8

* cited by examiner

SHIPPING UNIT

CROSS REFERENCE TO RELATED APPLICATION

This application claims the benefit of provisional application Ser. No. 60/512,024, filed on Oct. 17, 2003.

BACKGROUND OF THE INVENTION

This invention relates to an adjustable shipping tray particularly for shipping items of varying lengths. One example of the items of varying length is bath tiles. Many new and remodeled bathrooms now include a large single tile behind the bathtub against the back wall. These elongated tiles extend from one end of the bathtub to the other. Because of their length, these tiles are particularly susceptible to damage during shipping and transport to the installation site. At the same time, because of their length, these tiles are also expensive, such that breakage is particularly costly.

SUMMARY OF THE INVENTION

A shipping unit according to the present invention provides an adjustable shipping tray for shipping items of varying length.

The shipping unit of the present invention provides a first tray section and a second tray section. The first tray section includes parallel upper and lower bottom walls which define a slot there between, opposed side walls, an end wall, and an open end opposite the end wall. A forward portion of the lower bottom wall extends adjacent to the open end. The second tray section defines a bottom wall, opposing side walls, an end wall, and an open end opposing the end wall. A forward tongue extends forwardly away from the open end and is received within the slot of the first tray section such that the first and second tray sections are connected and may be moved relative to one another to accommodate tiles of varying lengths. The first and second tray sections further include base portions extending downwardly from the bottom walls for stacking of the shipping units.

In a second embodiment, the shipping unit includes a tray with open side walls and a lid connected to one of the side walls via a hinge. The lid includes an outwardly projecting tab and a slot on the opposite end of the lid from the tab. The shipping units are connected by snap fitting the tab of one shipping unit into the slot of another shipping unit.

The shipping unit of the present invention provides a stackable shipping tray that protects objects, such as costly tiles, when shipping and easily adjusts to accommodate various lengths of objects.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
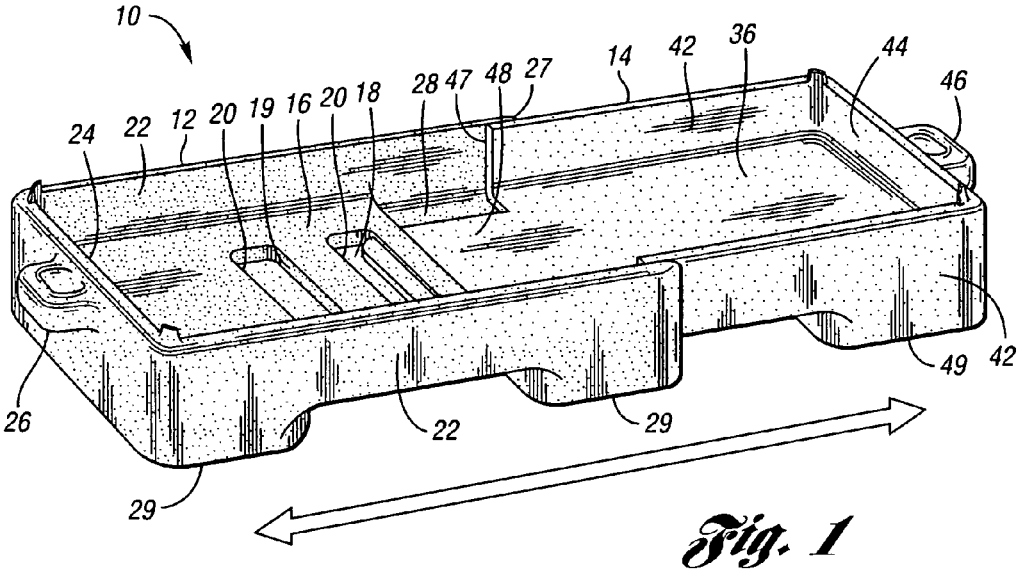
FIG. 1 is a perspective view of a shipping unit according to a first embodiment of the present invention.

A shipping unit 10 in accordance with a first embodiment of the present invention is shown in FIG. 1. The shipping unit 10 includes a first tray section 12 and a second tray section 14. The first tray section 12 includes an upper bottom wall 16 and a lower bottom wall 18 generally parallel to one another and spaced apart to define a slot 19. One or more holes 20 may also be formed in the upper bottom wall 16.

The first tray section 12 further includes a pair of opposed side walls 22 extending upwardly from the upper and lower bottom walls 16, 18. The first tray section 12 further includes an end wall 24 extending upwardly from the upper bottom wall 16. A handle 26 is formed on an exterior surface of the end wall 24. The first tray section 12 includes an open end 27 opposite the end wall 24. A forward portion 28 of the lower bottom wall 18 is adjacent the open end 27. The upper bottom wall 16 does not extend above the forward portion 28 of the lower bottom wall 18. The first tray section 12 further includes base portions 29 extending downwardly.

The second tray section 14 includes a bottom wall 36 up from which extend opposing side walls 42 and an end wall 44. The handle 46 is formed on an exterior surface of the end wall 44. The second tray section 14 has an open end 47 opposite the end wall 44. A forward tongue 48 extends forwardly away from the open end 47 of the second tray section 14. The second tray section 14 includes a base portion 49 extending downwardly.

The forward tongue 48 of the second tray section 14 is received within the slot 19 of the first tray section, between the upper bottom wall 16 and the lower bottom wall 18. The side walls 42 of the second tray section 14 are slidably received between the side walls 22 of the first tray section 12. The bottom wall 36 of the second tray section 14 is supported on the forward portion 28 of the lower bottom wall 18 of the first tray section 12. In this manner, the first and second tray sections 12, 14 are connected and may be moved relative to one another to create a shipping unit 10 of variable length.

Figure 2:
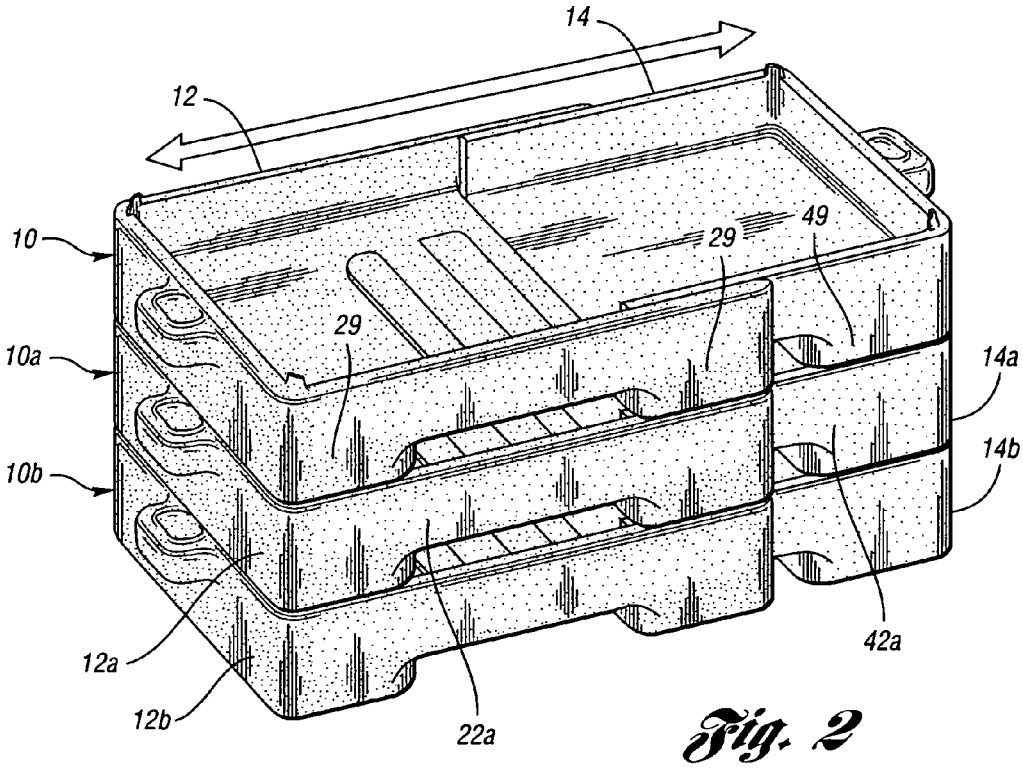
FIG. 2 is a perspective view of three of the shipping units of FIG. 1 stacked together.

Referring to FIG. 2, the shipping unit 10 is also stackable on similar shipping units 10*a*, 10*b*. The base portions 29, 49 of the upper shipping unit 10 are supported on the side walls 22*a*, 42*a* of the lower shipping unit 10*a*.

Figure 3:
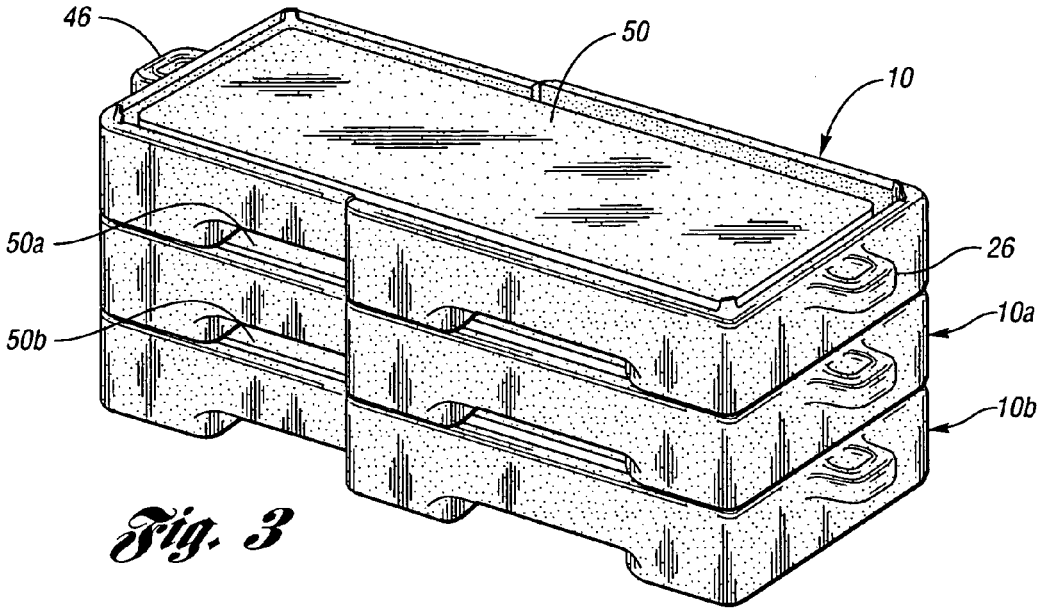
FIG. 3 is a perspective view of three shipping units of FIG. 1 holding bath tiles and stacked upon one another.

Referring to FIG. 3, in use, the trays 10 are adjusted to the proper length to accommodate the particular items, which in the example illustrated are bath tiles 50. The bath tiles 50, 50*a*, 50*b* are then placed inside the shipping units 10, 10*a*, 10*b*, respectively. For storage and for shipping, the trays 10 can be stacked upon one another while protecting the bath tiles 50. The tiles 50 and trays 10 can be carried by handles 26, 46. Although the invention is described for use with bath tiles 50 for purposes of illustration, the invention can be used for any items that may have varying lengths.

Figure 4:
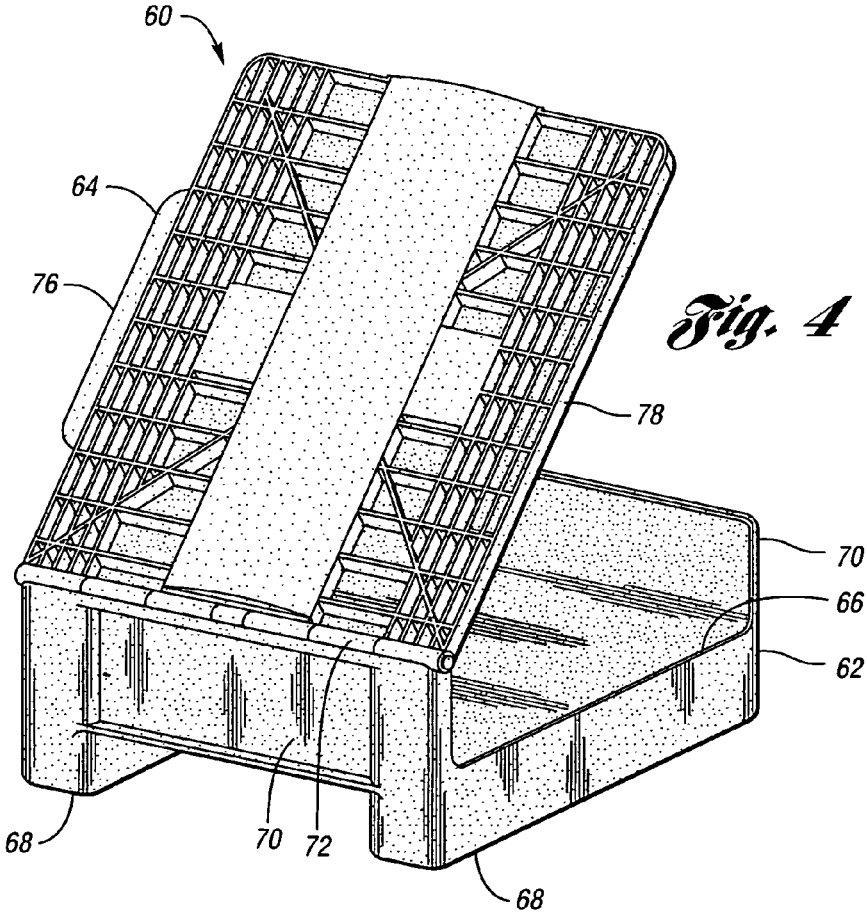
FIG. 4 is a perspective view of a shipping unit according to a second embodiment of the present invention.

A shipping unit 60 according to a second embodiment of the present invention is shown in FIG. 4. The shipping unit 60 includes a tray 62 and lid 64. The tray 62 generally comprises a bottom wall 66 from which base portions 68 extend downwardly. Side walls 70 extend upwardly from opposite sides of the bottom wall 66, while opposite ends between the side walls 70 are open. The lid 64 is connected to one of the side walls 70 via a hinge 72. One of the ends of the lid 64 adjacent the hinge 72 includes a tab 76 projecting outwardly, while the opposite end of the lid 64 includes a complementary slot 78 into which a tab 76 of a lid 64 of a similar shipping unit 60 can be snap fit.

Figure 5:
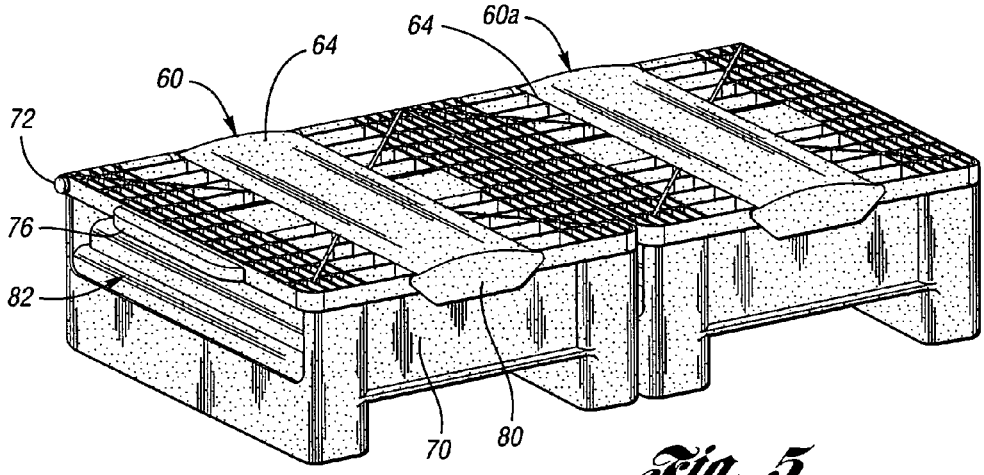
FIG. 5 is a perspective view of two connected shipping units of FIG. 4 containing a bath tile.
Figure 6:
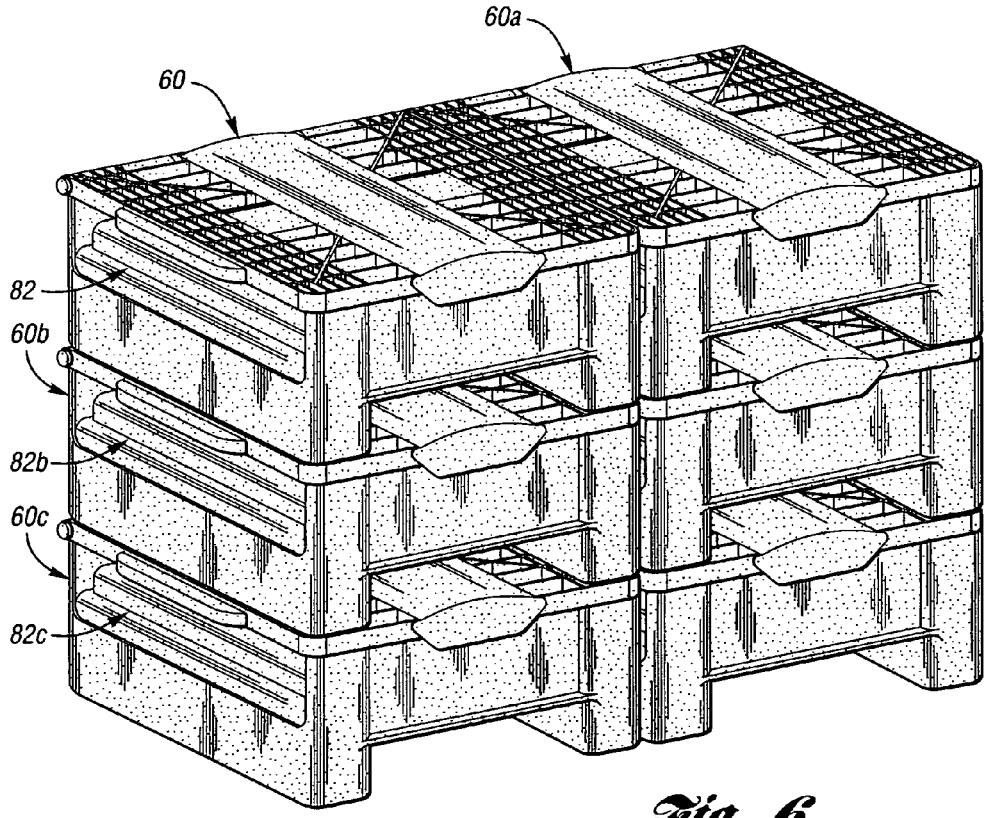
FIG. 6 illustrates the shipping units of FIG. 5 stacked upon other adjacent connected pairs of shipping units.

Referring to FIG. 5, the lid 64 includes a latch 80 at a side edge opposite the hinge 72. The latch 80 snap fits over the side wall 70 when the lid 64 is in the closed position. As shown in FIG. 5, the shipping unit 60 can be connected to multiple shipping units, such as 60*a*, to accommodate items of different lengths. The shipping units 60, 60*a* are connected by snap fitting the tab 76*a* (not visible) of one shipping unit 60*a* into a slot 78 (shown in FIG. 4) of the other shipping unit 60. In use, as many shipping units 60 as are needed to accommodate the entire length of the item 82 would be connected. In this manner, the multiple, connected shipping units 60, 60*a* can accommodate items 82 of various lengths. Again, although in the illustrated example, the items 82 are bath tiles the invention would also be useful for other items. As shown in FIG. 5, the two shipping units 60, 60*a* are connected together. The bath tile 82 is then laid in the shipping units 60, 60*a* and the lids 64 are closed. The bath tile 82 is stored and shipped in the connected shipping units 60, 60*a*, in which the bath tile 82 is protected. Additionally, as shown in FIG. 6, these shipping units 60, 60*a* may be stacked upon additional connected shipping units 60*b*, 60*c* also containing bath tiles 82*b*, 82*c*.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A shipping unit comprising:

a first tray section having a bottom wall and first and second side walls extending upwardly from the bottom wall, the bottom wall of the first tray section includes an upper bottom wall spaced apart from a lower bottom wall, the distance between the upper bottom wall and the lower bottom wall defining a slot, a forward portion of the lower bottom wall located below the slot adjacent an open end and extending past the upper bottom wall; and a second tray section having a bottom wall, first and second side walls and an end wall extending upwardly from the bottom wall, the second tray section including an open end opposite the end wall, a tongue extending forwardly away from the open end and receivable in the slot of the first tray section, one of the side walls of the first tray section is in a plane spaced outwardly from a plane of one of the side walls of the second tray section, wherein the first and second tray sections are slidably connected to accommodate items of different lengths.

2. The shipping unit of claim 1, wherein the end wall of the second tray section defines a handle on its outer surface.

3. The shipping unit of claim 1, wherein the first and second side walls of the second tray section are slidably receivable between the first and second side walls of the first tray section.

4. The shipping unit of claim 1, wherein the first and second side walls of the second tray section fit between an inner most surface of the first and second side walls of the first tray section.

5. The shipping unit of claim 1, wherein the first tray section includes an end wall extending upwardly from the upper bottom wall, the end wall defining a handle on its outer surface.

6. The shipping unit of claim 5, wherein the first tray section includes an open end opposite the end wall, the open end being adjacent to the forward portion of the lower bottom wall.

7. The shipping unit of claim 1, wherein the first tray section and the second tray section include a plurality of base portions extending downwardly from the bottom walls.

8. The shipping unit of claim 7, wherein the shipping unit is a first shipping unit, the base portions of the first and second tray sections of a like second shipping unit are selectively supported on the side walls of the first and second tray sections of the first shipping unit to stack the second shipping unit on the first shipping unit.

* * * * *